US006634996B2

(12) United States Patent
Jacobsen

(10) Patent No.: US 6,634,996 B2
(45) Date of Patent: Oct. 21, 2003

(54) EXERCISE APPARATUS

(75) Inventor: Neill Jacobsen, 3222 Long Iron Pl., Lawrenceville, GA (US) 30044

(73) Assignee: Neill Jacobsen, Chandler, AZ (US)

( * ) Notice: Subject to any disclaimer, the term of this patent is extended or adjusted under 35 U.S.C. 154(b) by 122 days.

(21) Appl. No.: 09/759,880

(22) Filed: Jan. 16, 2001

(65) Prior Publication Data

US 2002/0132710 A1 Sep. 19, 2002

(51) Int. Cl.[7] ..... A63B 21/068; A63B 69/06; A63B 21/00; A63B 26/00

(52) U.S. Cl. ..... 482/96; 482/72; 482/135; 482/142

(58) Field of Search ..... 482/96, 72, 135, 482/137, 140, 142, 95, 134, 136

(56) References Cited

U.S. PATENT DOCUMENTS 4,911,438 A * 3/1990 Van Straaten ..... 482/96
5,354,251 A * 10/1994 Sleamaker ..... 482/96
5,573,485 A * 11/1996 Geschwender ..... 482/112
5,674,167 A * 10/1997 Piaget et al. ..... 482/130
5,718,660 A * 2/1998 Chen ..... 482/144
5,906,564 A * 5/1999 Jacobsen ..... 482/135
5,941,803 A * 8/1999 Chamberlain et al. ..... 482/51
6,231,489 B1 * 5/2001 McBride et al. ..... 482/132

* cited by examiner

*Primary Examiner*—Nicholas D. Lucchesi
*Assistant Examiner*—Fenn C Matthew

(57) ABSTRACT

An exercise apparatus utilizing a wheeled rolling carriage which moves on a incline frame and includes an adjustable arm cable mounting assembly. The arm cable mounting system includes a pair of elongated arm cables each entrained over a fixed pulley mounted in each adjustable upright corner post. An anchoring device attach the cables to the mobile carriage. The carriage moves on the frame against a resistance force provided by the body weight of the user seating or lying on the platform and the up words angled slope of the incline frame. A back and head support connects the platform.

An attachable rowing device is mounted to the incline rails and connected to the mobile carriage through the cables assembly.

A leg push device is connected to the rails frame at the lower end.

An weights support arm is attached to the lower end of mobile carriage.

13 Claims, 11 Drawing Sheets

300 A

EXERCISE APPARATUS

Notice of References Cited:

| Document no. | Date | Name | Class | Subclass |
|---|---|---|---|---|
| 2,733,922 | 2/1956 | Diego | 482 | 96 |
| 4,383,684 | 5/1983 | Schliep | 482 | 96 |
| 4,468,025 | 8/1984 | Sferle | 482 | 96 |
| 4,911,438 | 3/1990 | Van Straaten | 482 | 96 |
| 5,354,251 | 10/1994 | Sleamaker | 482 | 96 |
| 5,492,518 | 2/1996 | Measom | 482 | 96 |
| 5,733,229 | 3/1998 | Dalebout et al. | 482 | 96 |
| 5,810,698 | 9/1998 | Hullett et al. | 482 | 96 |
| 5,906,564 | 5/1999 | Jacobsen | 482 | 96 |

BACKGROUND OF THE INVENTION

Field of the Invention

The present invention relates to a novel and useful exercise apparatus and relates to human body training concern with training the muscle of the "core", of the body which primarily helps to stabilize the body during a normal activities such as moving, standing and sitting.

Many exercise apparatuses have been proposed to rehabilitate or develop different muscles of the body. In addition, exercise apparatuses have used resistance devices such as weights and springs against which the user pushes or pulls, using the arms or legs.

Unfortunately many apparatuses are not susceptible to use by persons of different heights or physical abilities.

The traditional prior art bench like the Pilates type bench has been a useful device for muscle training but limit its utility and render it less than an optimum tool for practicing total body training.

Consequently, a need exists for improvement of the traditional prior art in order to enhance its overall utility.

An exercise apparatus using a incline frame and a wheeled platform which are adjustable to accommodate person of different heights and weights would be a notable advance in the physical conditioning of a large and various groups of muscles for total body training, conditioning and also physical therapy field.

SUMMARY OF THE INVENTION

In accordance with the present invention a novel and enhanced exercise apparatus is herein provided to satisfy the aforementioned needs.

The exercise apparatus of the present invention utilizes a wheeled carriage which is movable on a frame against a resistance force. The frame may provide a pair of rails and the carriage may include wheels to ride on such rails. The resistance force may be provided by the user body weight or when using the weights attachment, the resistance is provided by the weights, while the user can stand or sit on the ground next to the apparatus. Cables extended through a pulley system mounted to the carriage, at the end of rails assembly and to the far end to a pair of post mounted on a frame, to handles which are gripped by the user.

The posts are mounted on a frame and they can rotate 360 degree around the inner support frame in a vertical plane.

The posts frame is also adjustable and can rotate 270 degree from the vertical to horizontal plane, supported by a pair of clamps and locks in place at a desirable angle using a pair of locking bolts.

The apparatus of the present invention also includes two identical back platform supports connected to each end of the mobile carriage.

The two identical back platform supports can be also used as a leg or arm device and for abdominal muscle conditioning.

The apparatus of the present invention also includes an attachable rowing, leg push and weights devices to be used for total body conditioning.

It may be apparent that a novel and useful exercise apparatus has been described. It is therefore an object of the present invention to provide an exercise apparatus that utilizes a wheeled carriage and requires the user to pull the carriage up words on an incline slope.

Another object of the present invention is to provide an exercise apparatus using wheeled carriage moveable against a resistance force which is adjustable through the change of the slope angle and the users weight, for users of different height, weight and physical abilities, while the user is seating or lying on the carriage or siting or lying on the floor, when the weights attachment is used.

Yet another object of the present invention is to provide an exercise apparatus which is compact and easy to assemble and use.

A further object of the present invention is to provide an exercise apparatus which employs a wheeled rolling carriage and a multiplicity of platform supports permitting the use of the exercise apparatus in various conditioning and therapeutic situations. Yet another object of the present invention is to provide an exercise apparatus which provides a wheeled rolling carriage permitting the use of the legs for the conditioning of the legs major muscle groups at the same time.

Another object of the present invention is to provide an exercise apparatus which provides a rowing attachment and a leg push attachment permitting the use of the arms and legs for the conditioning of the arms, legs and other body major muscle groups.

Yet another object of the present invention is to provide an exercise apparatus which provides a weights attachment mounted to the rolling carriage, permitting the user to stand or sit on the ground and permitting the use of the arms and legs for the conditioning of the arms, legs and other body major muscle groups, in a lateral or bilateral movement.

The invention possesses other objects and advantages especially as concerns particular characteristics and features thereof, which will become apparent as the specification continues.

DESCRIPTION OF THE PREFERRED EMBODIMENTS

Figure 1:
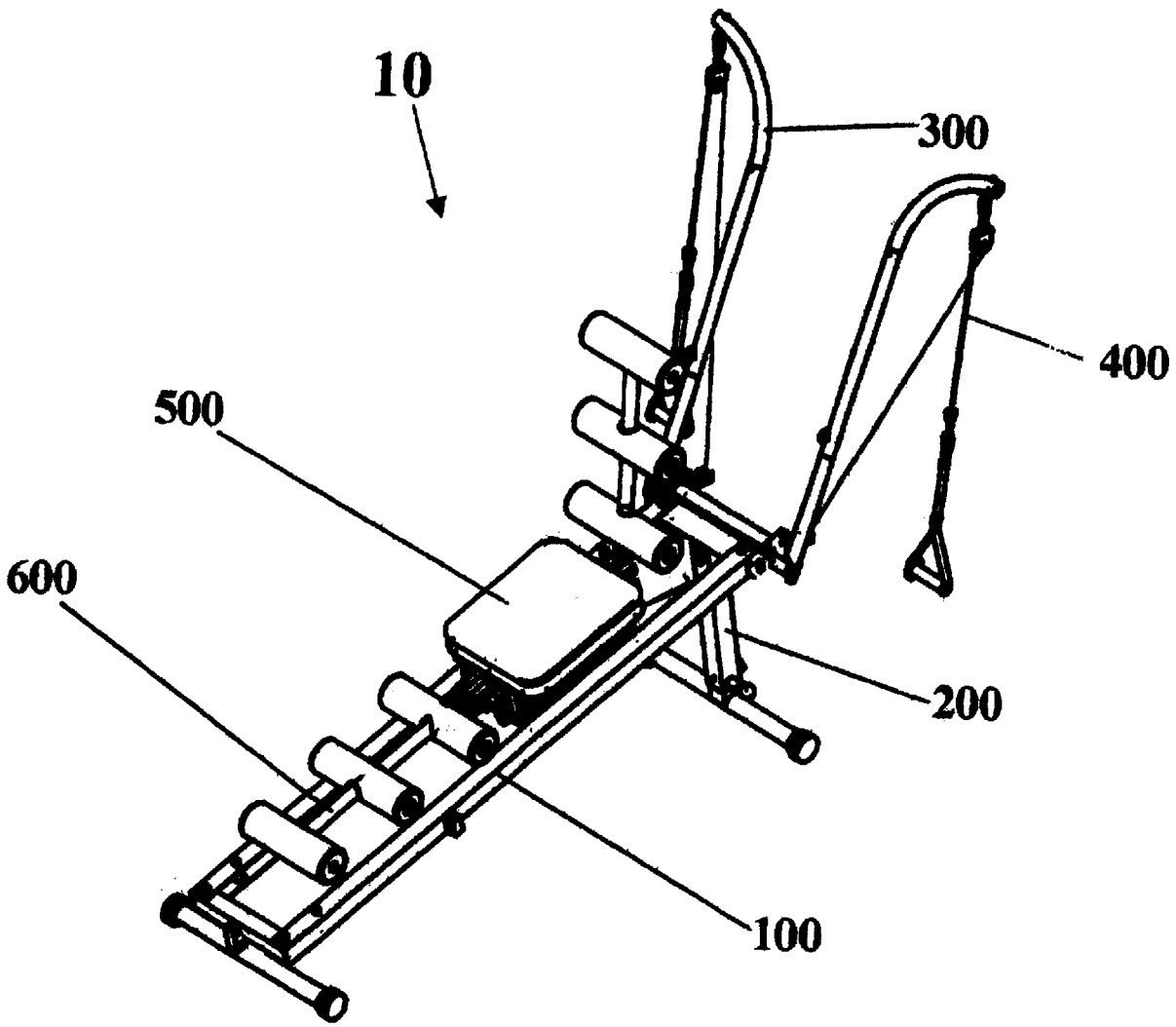
FIG. 1 is an isometric view of an embodiment of the apparatus "10" (without the attachments) of the present invention.

Various aspects of the present invention will evolve from the following detailed description of the preferred embodiments thereof which should be referenced to the herein above described drawings.

In the following description, like reference characters designate like or corresponding parts throughout the several views of the drawings. Also in the following description, it is to be understood that such terms as "front rear upper lower left right", and the like, are words of convenience and are not to be construed as limiting terms. In General Referring to the drawings, and particularly to FIGS. 1–10 there is shown an enhanced core movement training apparatus, generally designated 10,10 A, 10 B, and 10 C incorporating all improved futures of the present invention.

The apparatus as a hole is depicted in the drawings by reference character 10,10 A, 10 B, and 10 C and upper case letter to denote multiple embodiments.

Figure 10:
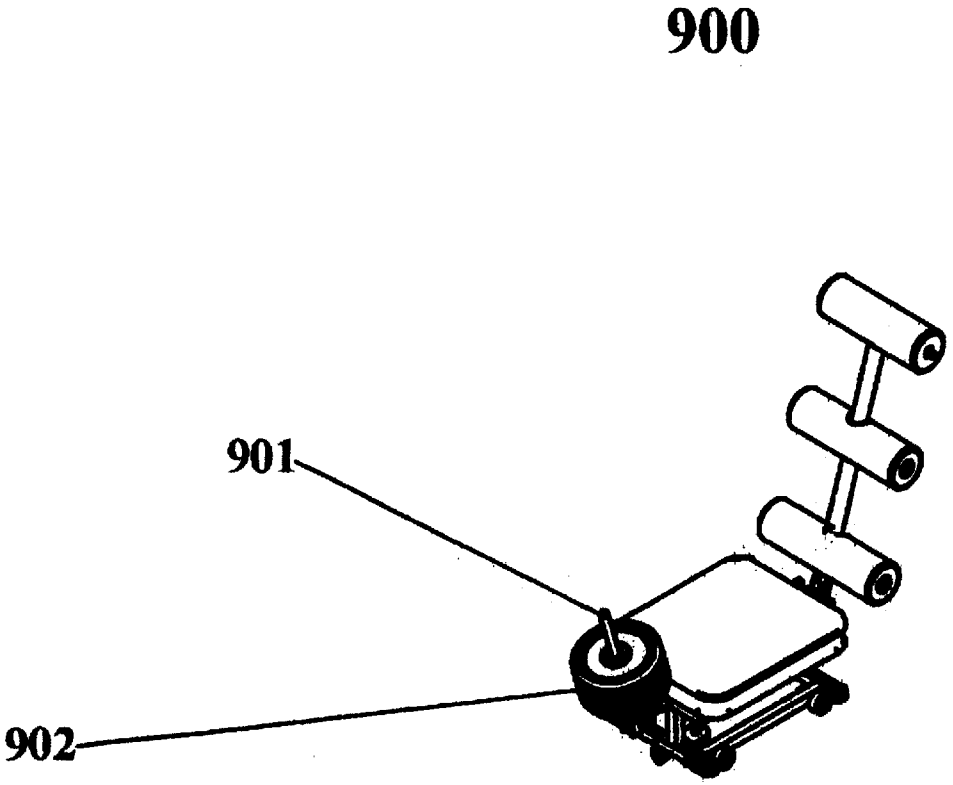
FIG. 10 is an isometric view of the weights attachment assembly 900.

Apparatus 10,10 A, 10 B, and 10 C incorporates nine major embodiments (as viewed in FIG. 1, through FIG. 10).

Figure 5:
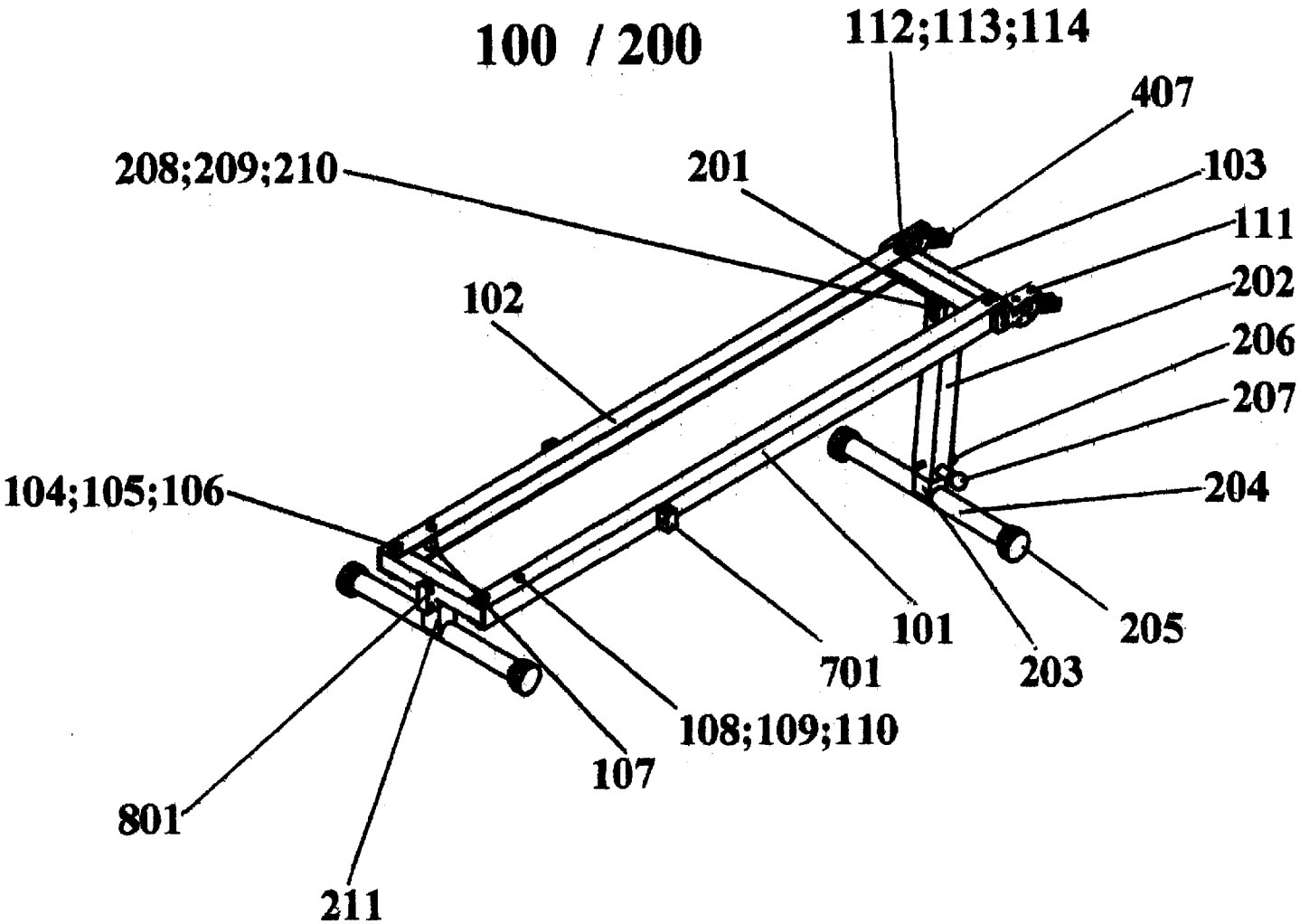
FIG. 5 is an isometric view of the rails assembly 100 and the leg assembly 200.

The first major embodiment is the "Rails assembly" 100 which include two "U" shape rails 101 and 102 connected to end brackets 103 by a set of detachable fasteners 104, 105 and 106 (as viewed in FIG. 5).

The end bracket 103 at the higher end is connected to leg extension bracket 201 by welding and the leg extension bracket 201 is connected to adjustable leg 202 by a set of detachable fasteners 208, 209, and 210 (as viewed in FIG. 5).

The end bracket 103 at the lower end is connected to lower leg 211 by welding (as viewed in FIG. 5).

At the lower end there is a leg push bracket 801 connected to end bracket 103 and lower leg 211 by welding (as viewed in FIG. 5).

Near lower end, there is a set of rowing support brackets 701 connected to rail 101 and 102 by welding (as viewed in FIG. 5).

At lower end there are a pair of carriage stops 107 connected to rail 101 and 102 by a set of detachable fasteners 108,109 and 110, used for safety purpose to stop the carriage assembly 500 away from end bracket 103 (as viewed in FIG. 5).

The second major embodiment is the "Legs assembly" 200 (as viewed in FIG. 5). Lower leg 211 includes a round horizontal base tubing 204 and an end cap 205. The adjustable leg 200 has a lower leg member who includes a round horizontal base tubing 204 and a vertical rectangular tubing 203 interconnected by welding. Further the adjustable leg 200 has an upper leg member which includes a vertical rectangular tubing 202 interconnected by a set of detachable fasteners 208,209 and 210 to leg extension bracket 201.

A detachable self-locking pin 206 connects the lower and higher members of leg 200. The upper leg member 202 also includes a self-locking pin connected at the lower end by welding and is used for safety purpose to stop the adjustable member 202 from disengaging from member 203 when apparatus is raised at the highest limit. The horizontal base tubing 204 of legs 200 and 211 are supported by a set of end caps 205.

At the upper end there are two post frame clamps 111 connected to the rails 101 and 102 by a set of detachable fasteners 112,113 and 114, used to support the post frame assembly 300 (as viewed in FIGS. 1–4).

The third major embodiment of the apparatus 10, 11A, 10B, and 10C is the "Post Assembly" 300 (as viewed in FIGS. 6 and 6A) which includes an inner frame 305 and an outer frame 304, a pair of posts 301 and 302 mounted over the inner frame 305 by a set of detachable eyebolts 306 and set of detachable fasteners 308, and 309.

A set of detachable eyebolts 306 and set of detachable fasteners 308, and 309 are also mounted at the upper end of posts 101 and 102 and are used to connect the pulley assembly 400.

The posts 301 and 302 can rotate 360 degrees and can be locked at a desired angle by the set of eyebolts 306.

Figure 6:
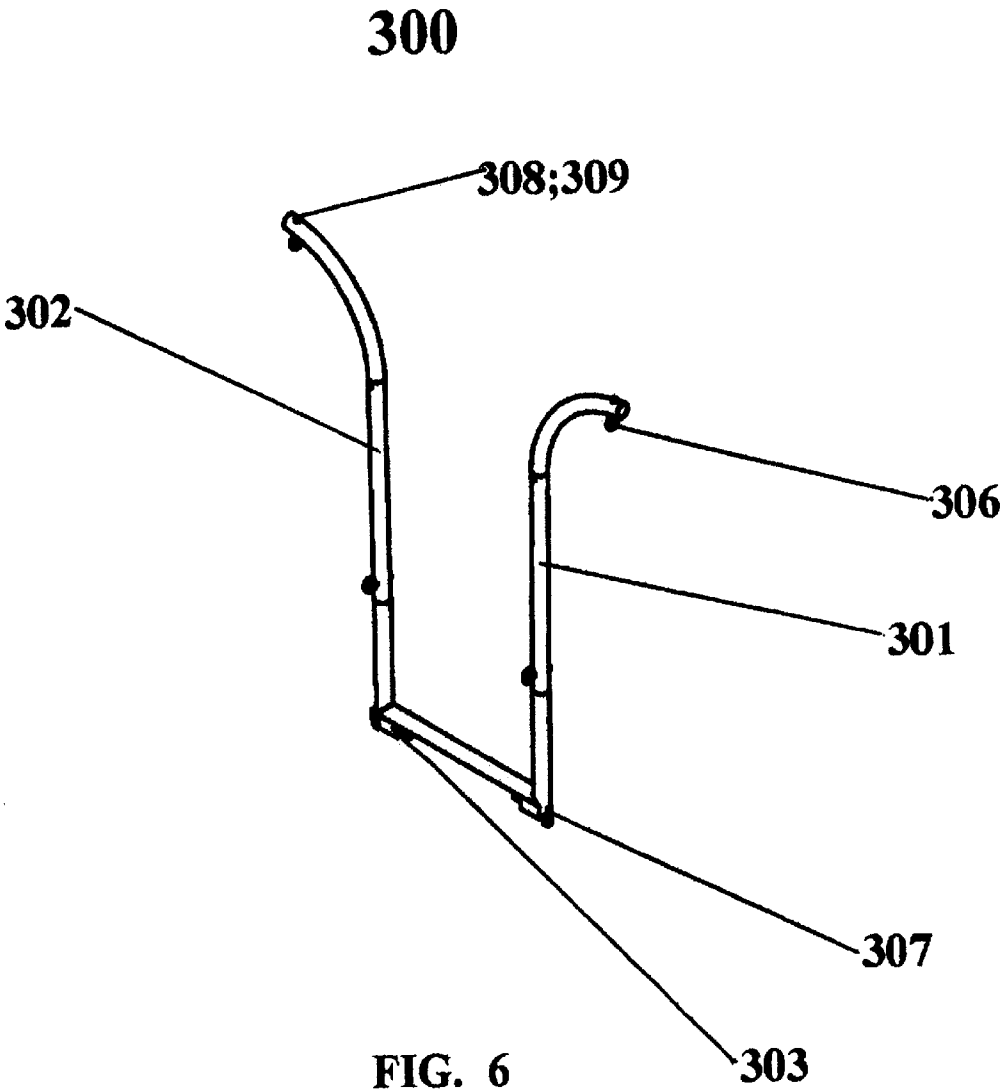
FIG. 6 is an isometric view of the posts assembly 300.
Figure 6A:
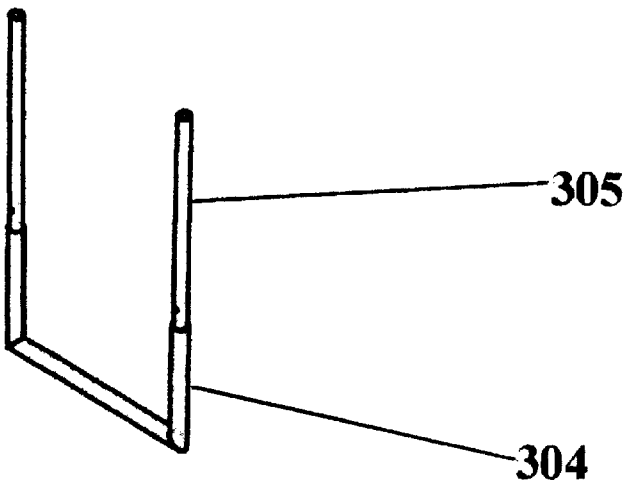
FIG. 6A is an isometric view of the posts frame assembly 300 A.

The Post Assembly 300 also includes a pair of lock blocks 303 connected to outer post frame 304 by welding (as viewed in FIG. 6).

The lock blacks 303 are used to lock in place the Post Assembly frame 300 at a desirable angle using a pair of threaded lock pins 307 and the set of clamps 111.

Figure 2:
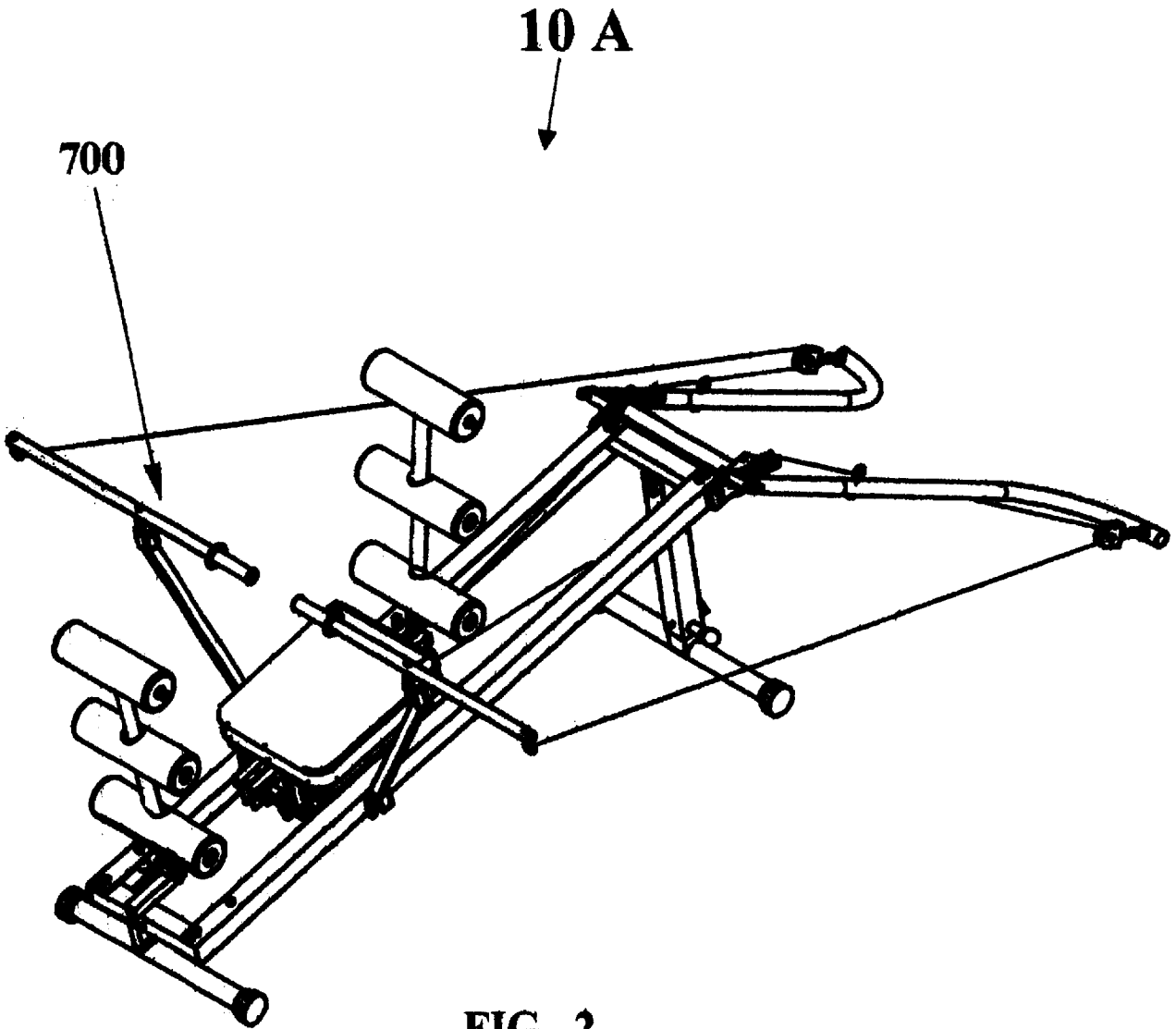
FIG. 2 is an isometric view of an embodiment of the apparatus "10 A" showing the rowing attachments and legs push of attachment of the present invention.
Figure 3:
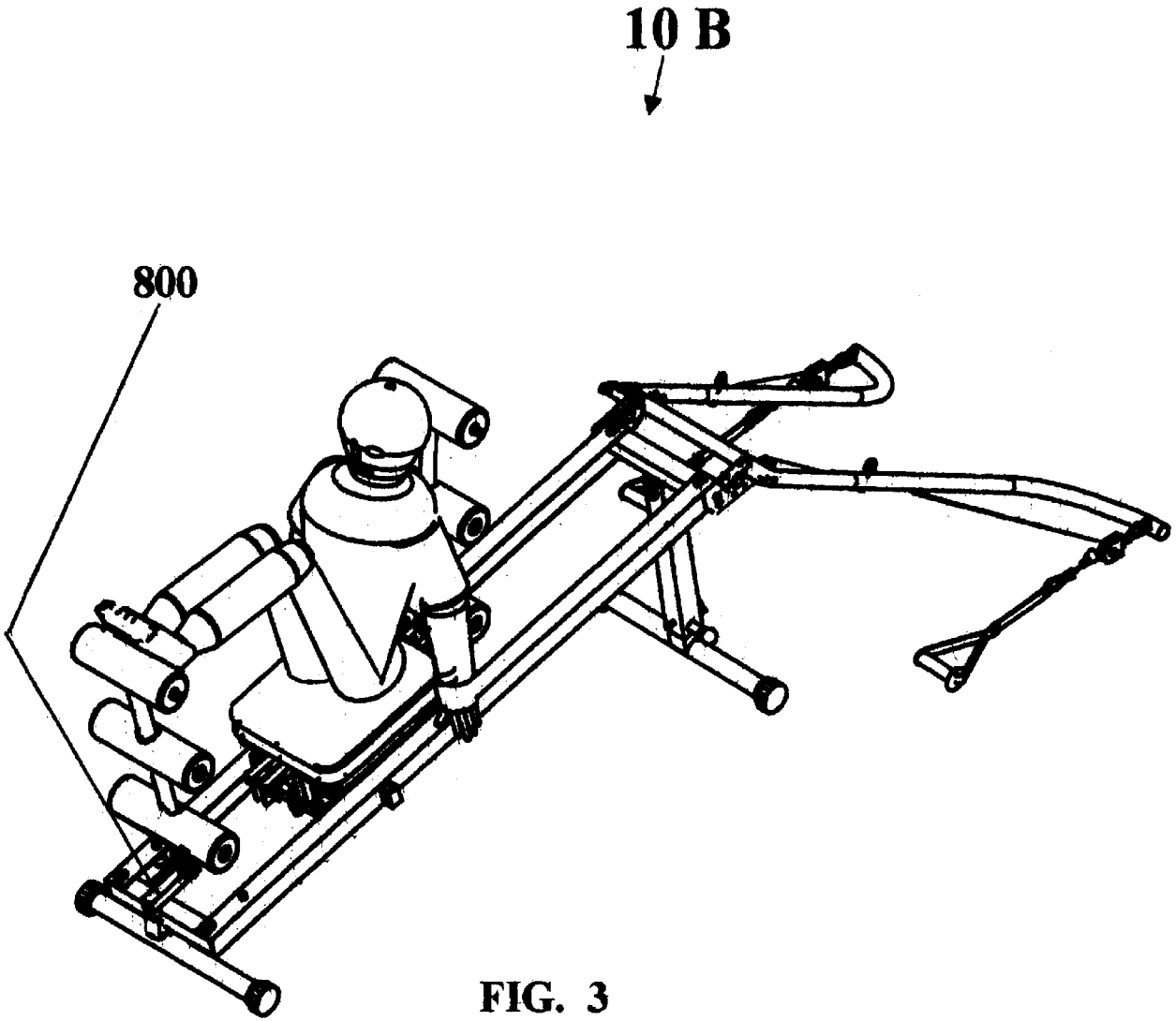
FIG. 3 is an isometric view of an embodiment of the apparatus "10 B" showing the legs push attachment of the present invention.
Figure 4:
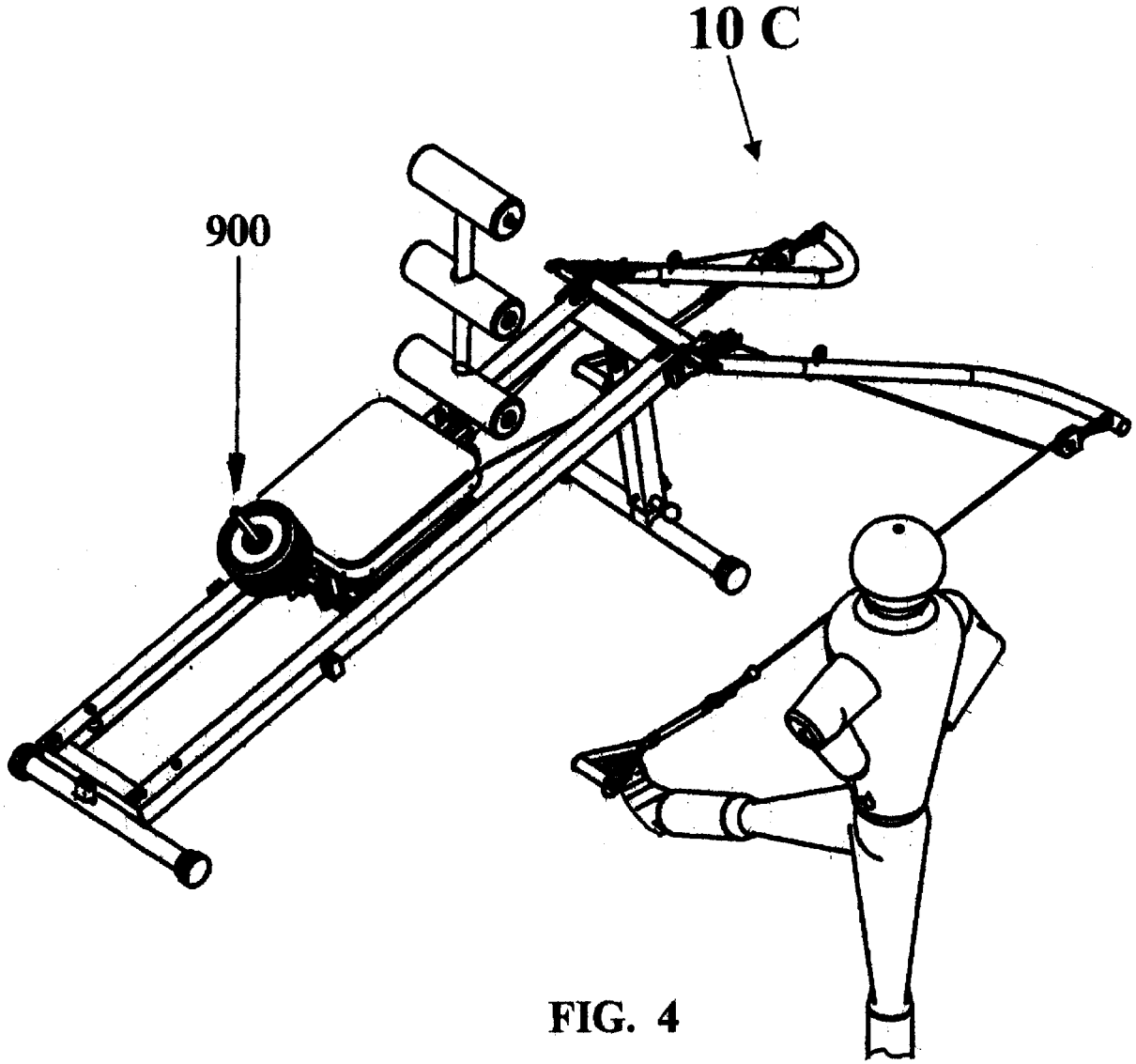
FIG. 4 is an isometric view of an embodiment of the apparatus "10 C" showing the weights attachment of the present invention.

The Post Assembly frame 300 can rotate 270 degree on a vertical plane and lock in place at a desirable angle (as viewed in FIGS. 2,3 and 4).

Figure 7:
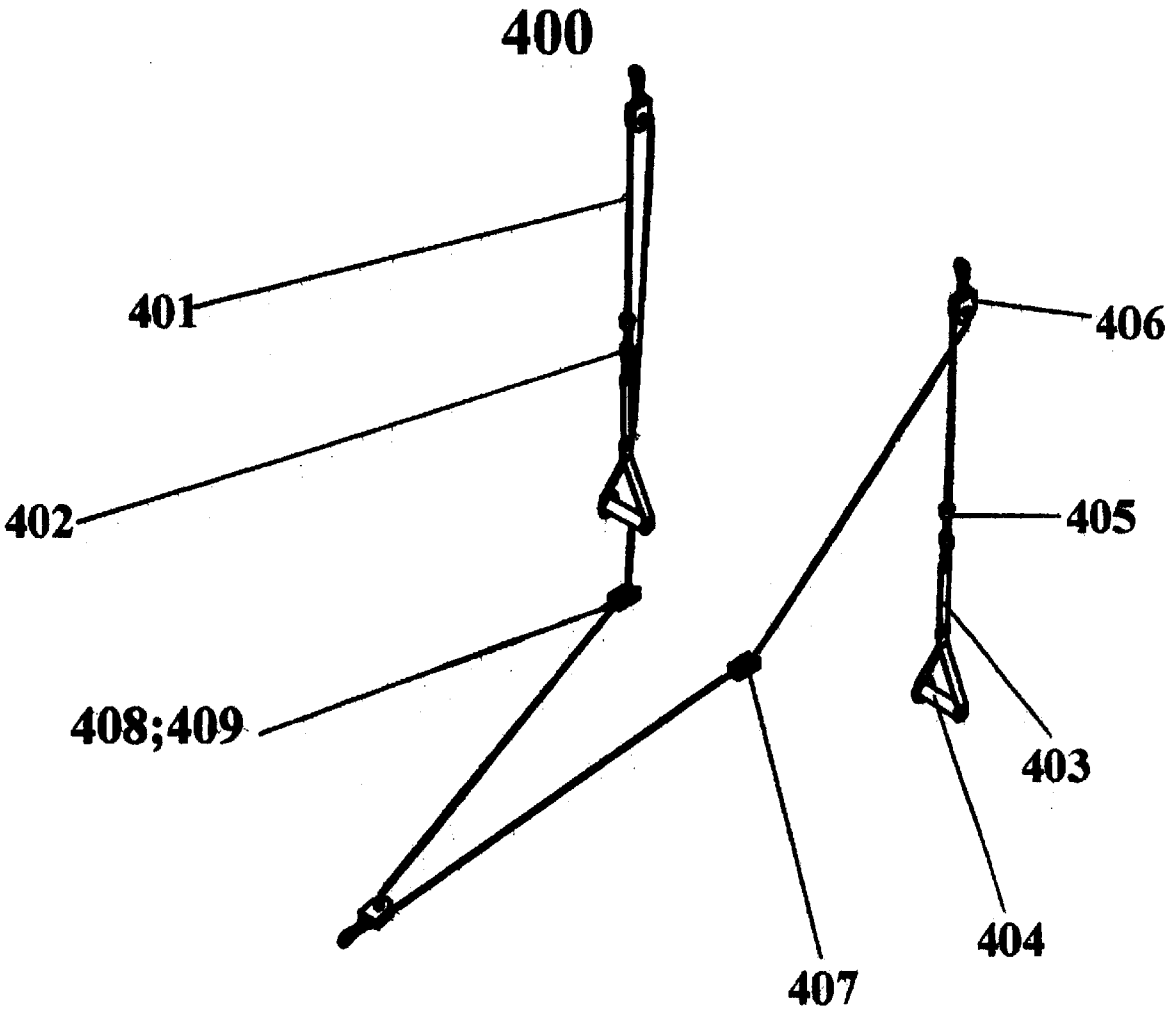
FIG. 7 is an isometric view of the pulley assembly 400.

The fourth major embodiment of the apparatus 10, 10A, 10B, and 10C "Pulleys Assembly" 400 (as viewed in FIG. 7).

The pulley assembly includes a single horizontal pulley 406 connected by a detachable hook 402 to the undercarriage frame 501, a two double pulleys 407 connected by a set of detachable fasteners 408 and 409 to clamp 111, and a pair of single vertical pulleys 406 connected to the pair of posts 301 and 302 by a set of detachable hooks 402.

Further the pulley assembly includes a cable 401 which it is entrained over a horizontal pulley, 406 mounted to the carriage frame 501, further both ends of the cable 406 are extended through a fixed pair of pulleys 407 mounted on clamp 111 and extended through a pair of vertical pulley 406 connected to each adjustable posts 301 and 302.

Each end of the cable 401 is connected to the pair of cord hooks 402 which are connected to the pair of straps 403, which are further connected to the pair of handles 404.

The pulley assembly 400 also includes a rubber stop 405 mounted on the cable 401 near handles.

Figure 8:
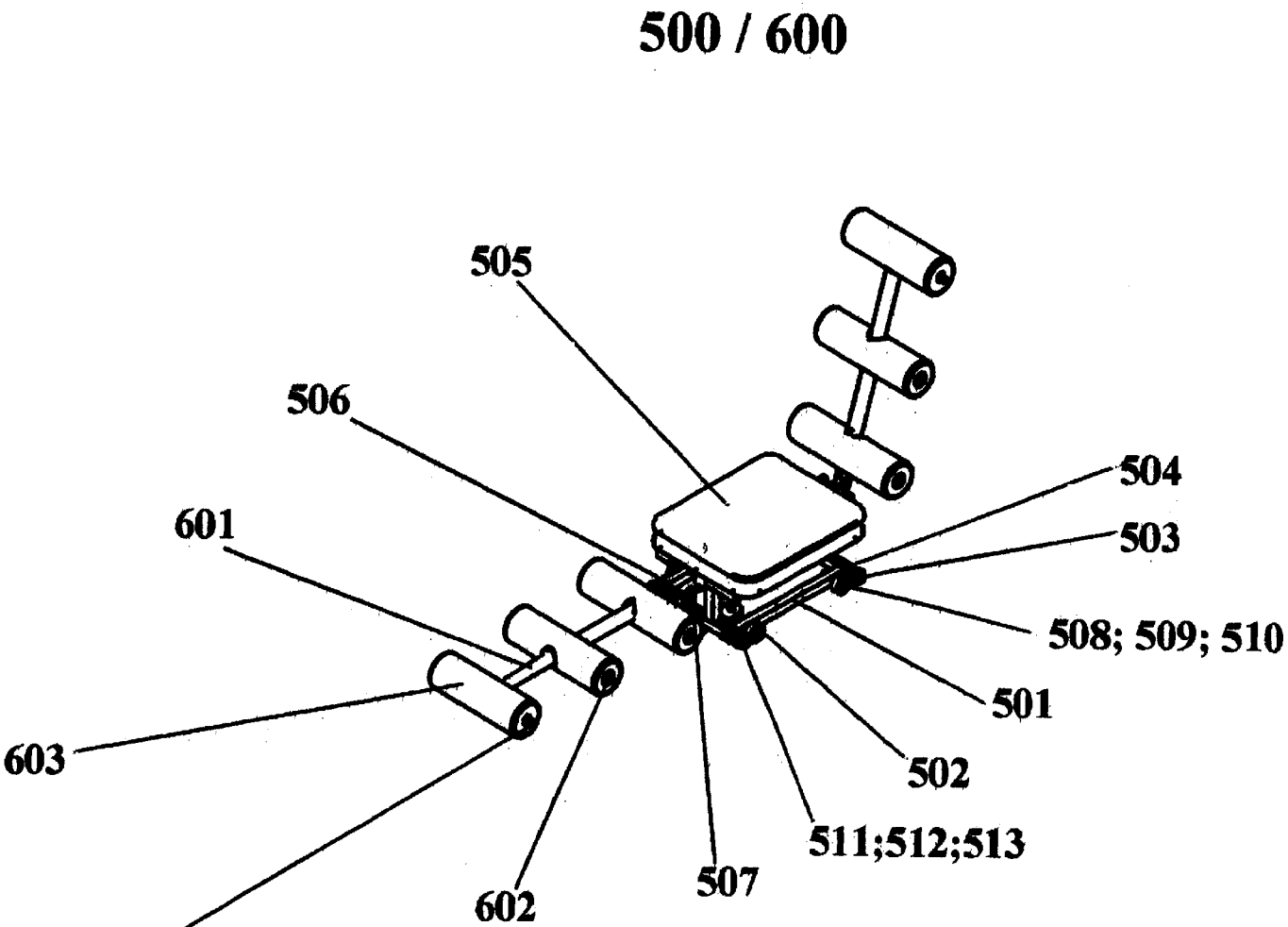
FIG. 8 is an isometric view of the carriage assembly 500 and platform assembly 600.

The fifth major embodiment is the "Carriage Assembly" 500 (as viewed in FIG. 8). As illustrated in FIG. 8 the "Carriage Assembly" 500 includes a frame 501, a set of wheels 502 mounted to the frame 501 by a set of detachable fasteners 508, 509 and 510.

Further more the "Carriage Assembly" 500 includes a set of guide wheels 503 connected to the frame 501 by a set of brackets 504 and a set of detachable fasteners 511, 512 and 513.

The "Carriage Assembly" 500 includes a set of platform adjustable brackets 506 mounted by welding to each end of frame 501, and used to connect the end platforms assembly 600 by a set of lock pins 507 to carriage assembly 500.

Further more the "Carriage Assembly" 500 includes a flat padded carriage top 505 connected to the carriage frame 501 by a set of detachable fasteners. The mobile carriage 500 rolls on rails 101 and 102 which have a "U" shape profile and thereby providing more safety, smooth and accurate rolling motion of the wheels 502.

The mobile carriage 501 uses a set of wheels 503 as guides mounted in a horizontal position and are used to eliminate the usual wheel to side scuffing associated with the traditional prior art bench.

The sixth major embodiment is the "Platform Assembly" 600 (as viewed in FIG. 8). As illustrated in FIG. 8 the "Platform Assembly" 600 includes a platform bar 601, and three cross bars 602 connected to the platform bar 601, by the foam sleeves 603. Further more the "Platform Assembly" 600 includes a set of foam sleeves 603, connected to the platform bar 601 by the cross bar 602.

The "Platform Assembly" 600 includes a nylon strap eyelet that is connected through the cross bar at each of the higher ends of the Platform Assembly 600, and is used to connect the cables of pulley assembly 400, when used as legs device and for abdominal muscles conditioning.

The "Platform Assembly" 600 can rotate freely and can be locked in four different positions from vertical to horizontal plane by detachable sets of locking pins when used for back or leg support.

Figure 9:
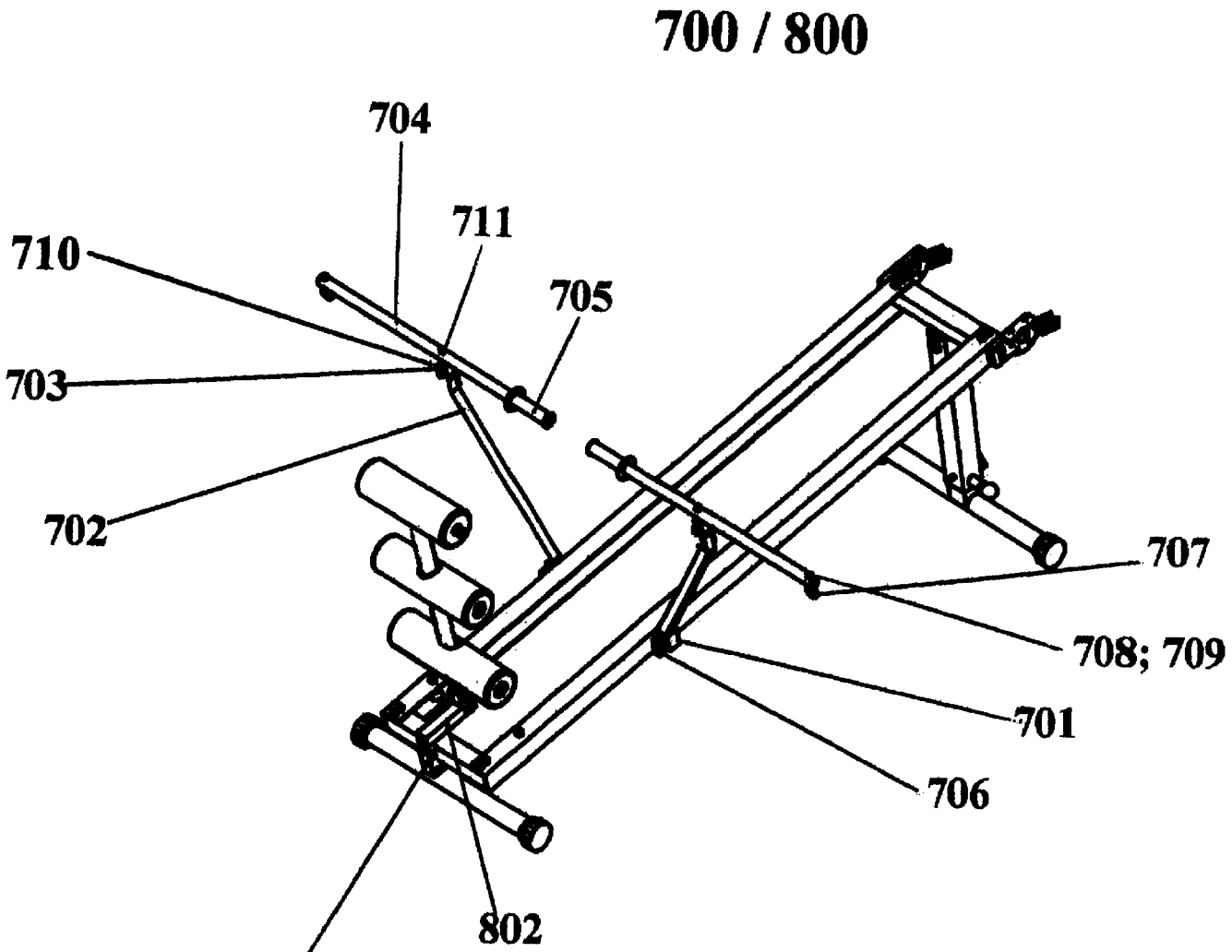
FIG. 9 is an isometric view of the rowing attachment assembly 700 and leg push attachment assembly 800.

The seventh major embodiment is the "Rowing Attachment Assembly" 700 (as viewed in FIG. 9).

As illustrated in FIG. 9 the "Rowing Attachment Assembly" 700 includes a support bracket 701 connected to the rails 101 and 102 by welding, a extension bracket 702 connected to support bracket 710 by a set of lock pins 706.

Further more the "Rowing Attachment Assembly" 700 includes a swivel bracket 703 connected to extension bracket 702 by a set of fasteners 710.

The "Rowing Attachment Assembly" 700 also includes arm 704 connected to the swivel bracket 703 by a set of fasteners 711, and a pair of handles 705.

The arm 704 can rotate from horizontal to vertical plane by the swivel bracket 703, providing the user with various angles of work out, and reproducing the movement of rowing.

The arm 704 rotate on the horizontal plane when a puling force is apply by the user, and will cause the carriage assembly to roll up on the inclined slope.

The eight major embodiment is the "Leg Push Attachment Assembly" 800 (as viewed in FIG. 9).

As illustrated in FIG. 9 the "Leg Push Attachment Assembly" 800 includes a support bracket 801 connected to end bracket 103 and lower leg 211 by welding. The "Leg Push Attachment Assembly" 800 also includes the Arm 802 connected at one end to the bracket 801 and at the other end to the platform assembly 600 by a set of locking pins 706.

The Leg Push Attachment Assembly 800 can be used alone for leg pushes or in connection with the Rowing Attachment Assembly 700 when apparatus is used for rowing.

The ninth major embodiment is the "Weights Attachment Assembly" 900 (as viewed in FIG. 10).

As illustrated in FIG. 10 the "Weights Attachment Assembly" 900 includes a support arm 901 and a set of weights 902.

The "Weights Attachment Assembly" 900 is connected to the carriage assembly 500 by a set of lock pins 507, and can be used for exercising the legs or arms with the user siting or standing on the ground and not on the carriage.

These types of exercises can be leg swings, with the cable attached to a harness and to the user ankles, or unilateral/bilateral arms exercises with the user laying standing or siting on the ground.

What is claim is:

1. An exercise apparatus comprising an elongated main frame further comprised of a pair of parallel U-shaped rails interconnected at either end by a first and second end member, the first end member being pivotally connected to a vertical lower support member, and the second end member being pivotally connected to a vertical higher support member; a U-shaped post frame connected at an upper end of each rail, the U-shaped post frame being rotatable 270 degrees, and a leg push attachment connected to an upper portion of the vertical lower support member; a user carriage having rollers that engage with said rails, and a back support extension having means for selectively pivoting and locking said back support extension in a desired angular position with respect to the user carriage, a first end post and a second post pivotally connected to said U-shaped post frame, the end posts rotatable 360 degrees about a post frame axis, connector means extendible through a pulley assembly, wherein engagement of the pulley assembly by a user supported on the user carriage moves the user carriage along the length of the elongated main frame; a pair of detachable rowing members connected to a pair of brackets located on either pair of rails and engaged with the pulley assembly.

2. The exercise apparatus of claim 1 wherein said vertical higher support member is comprised of telescopically adjustable outer and inner member.

3. The exercise apparatus of claim 1 wherein the pulley assembly comprises a first pulley attached to a distal end of the first end member, a second pulley attached to a distal end of the second end member, a third pulley attached to the first end post, a fourth pulley attached to the second end post, and a fifth pulley attached to the user carriage.

4. The exercise apparatus of claim 3 wherein the connector means comprises a cable having a first end and a second end.

5. The exercise apparatus of 4 wherein the cable includes a removable handle at the first end, and a removable handle at the second end.

6. The exercise apparatus of claim 1 wherein the U-shaped post frame is locked at a desired angle with a pair of threaded lock pins.

7. The exercise apparatus of claim 1 wherein the back support extension and leg push attachment are each comprised of a platform bar and a plurality of cross bars, the plurality of cross bars having foam sleeves.

8. An exercise apparatus comprising an elongated main frame further comprised of a pair of parallel U-shaped rails interconnected at either end by a first and second end member, the first end member being pivotally connected to a vertical lower support member, and the second end member being pivotally connected to a vertical higher support member; a U-shaped post frame connected at an upper end of each rail, the U-shaped post frame being rotatable 270 degrees; a user carriage having rollers that engage with said rails, and a back support extension having means for selectively pivoting and locking said back support extension in a desired angular position with respect to the user carriage, a first and second end post pivotally connected to said first and second post frame, the end posts rotatable 360 degrees about a post frame axis, connector means extendible through a pulley assembly, wherein engagement of the pulley assembly by a user supported on the user carriage moves the user carriage along the length of the elongated main frame; a detachable weight assembly comprising a support arm and a set of weights connected to a lower end of the user carriage.

9. The exercise apparatus of claim 7 wherein said vertical higher support member is comprised of telescopically adjustable outer and inner member.

10. The exercise apparatus of claim 7 wherein the pulley assembly comprises a fist pulley attached to a distal end of the first end member, a second pulley attached to a distal end of the second end member, a third pulley attached to the first end post, a fourth pulley attached to the second end post, and a fifth pulley attached to the user carriage.

11. The exercise apparatus of claim 9 wherein the connector means comprises a cable having a first end and a second end.

12. The exercise apparatus of claim 10 wherein the cable includes a removable handle at the first end, and a removable handle at the second end.

13. The exercise apparatus of claim 8 wherein the U-shaped post frame is locked at a desired angle with a pair of threaded lock pins.

* * * * *